United States Patent [19]

Nguyen

[11] Patent Number: 4,936,932

[45] Date of Patent: Jun. 26, 1990

[54] AROMATIC HYDROCARBON-BASED EMULSION EXPLOSIVE COMPOSITION

[75] Inventor: Anh D. Nguyen, Brossard, Canada

[73] Assignee: C-I-L Inc., North York, Canada

[21] Appl. No.: 430,327

[22] Filed: Nov. 2, 1989

[30] Foreign Application Priority Data

Nov. 7, 1988 [CA] Canada ..... 582444

[51] Int. Cl.[5] ..... C06B 45/00

[52] U.S. Cl. ..... 149/2; 149/47; 149/62; 149/78; 149/89; 149/90

[58] Field of Search ..... 149/2, 89, 90, 47, 62, 149/78

[56] References Cited

U.S. PATENT DOCUMENTS

| | | | |
|---|---|---|---|
| 3,447,978 | 6/1969 | Bluhm | 149/2 |
| 3,674,578 | 7/1972 | Cattermole et al. | 149/2 |
| 3,715,247 | 2/1973 | Wade | 149/21 |
| 3,765,964 | 10/1973 | Wade | 149/2 |
| 3,770,522 | 11/1973 | Tomic | 149/2 |
| 4,104,092 | 8/1978 | Mullay | 149/2 |
| 4,110,134 | 8/1978 | Wade | 149/2 |
| 4,111,727 | 9/1978 | Clay | 149/2 |
| 4,138,281 | 2/1979 | Olney et al. | 149/2 |
| 4,141,767 | 2/1979 | Sudweeks et al. | 149/2 |
| 4,149,916 | 4/1979 | Wade | 149/56 |
| 4,149,917 | 4/1979 | Wade | 149/56 |
| 4,216,040 | 8/1980 | Sudweeks et al. | 149/21 |
| 4,218,272 | 8/1980 | Brockington | 149/21 |
| 4,231,821 | 11/1980 | Sudweeks et al. | 149/21 |
| 4,310,364 | 1/1982 | Ekman et al. | 149/2 |
| 4,545,829 | 10/1985 | Starkenberg et al. | 149/109.6 |
| 4,708,753 | 11/1987 | Forsberg | 149/2 |

FOREIGN PATENT DOCUMENTS

| | | |
|---|---|---|
| 1096173 | 2/1981 | Canada . |
| 1244463 | 11/1988 | Canada . |

*Primary Examiner*—Stephen J. Lechert, Jr.
*Attorney, Agent, or Firm*—C. Brian Barlow

[57] ABSTRACT

An emulsion explosive composition comprising a discontinuous oxidizer phase and a continuous fuel phase is provided wherein the fuel phase comprises an aromatic hydrocarbon compound. The composition essentially contains as the emulsifying agent a polyisobutylene succinic anyhdride-based compound in admixture with an ester of 1-4 sorbitan and oleic acid. The composition demonstrates high explosive strength and excellent stability.

13 Claims, No Drawings

AROMATIC HYDROCARBON-BASED EMULSION EXPLOSIVE COMPOSITION

BACKGROUND OF THE INVENTION

1. Field of the Invention

The present invention relates to explosive compositions of the water-in-fuel emulsion type in which an aqueous oxidizer salt solution is dispersed as a discontinuous phase within a continuous phase of a liquid or liquefiable carbonaceous fuel.

2. Description of the Prior Art

Water-in-fuel emulsion explosives are now well known in the explosives art and have been demonstrated to be safe, economic and simple to manufacture and to yield excellent blasting results. Bluhm, in U.S. Pat. No. 3,447,978, disclosed an emulsion explosive composition comprising an aqueous discontinuous phase containing dissolved oxygen-supplying salts, a carbonaceous fuel continuous phase, an occluded gas and an emulsifier. Since Bluhm, further disclosures have described improvements and variations in water-in-fuel explosives compositions.

These include U.S. Pat. No. 3,674,578, Cattermole et al.; U.S. Pat. No. 3,770,522, Tomic; U.S. Pat. No. 3,715,247, Wade; U.S. Pat. No. 3,675,964, Wade; U.S. Pat. No. 4,110,134, Wade; U.S. Pat. No. 4,149,916, Wade; U.S. Pat. No. 4,149,917, Wade; U.S. Pat. No. 4,141,767, Sudweeks & Jessup; Canadian Patent No. 1,096,173, Binet & Seto; U.S. Pat. No. 4,111,727, Clay; U.S. Pat. No. 4,104,092, Mullay; U.S. Pat. No. 4,231,821, Sudweeks & Lawrence; U.S. Pat. No. 4,218,272, Brockington; U.S. Pat. No. 4,138,281, Olney & Wade; and U.S. Pat. No. 4,216,040, Sudweeks & Jessup. Starkenberg et al., in U.S. Pat. No. 4,545,829, describe a process for making an amatol explosive wherein an emulsion of ammonium nitrate in melted TNT is produced with emulsion is thereafter cast into shapes. Ekman et al., in U.S. Pat. No. 4,310,364, disclose a cap-sensitive, water-in-fuel emulsion in which the fuel phase consists primarily of aromatic nitro-compounds. However, the compositions of Ekman et al. have proven to be of limited commercial value because the emulsion formed is short-lived and highly crystallized and, hence, soon loses its stability and sensitivity, particularly at low temperatures.

SUMMARY OF THE INVENTION

The present invention provides a water-in-fuel emulsion composition which comprises:

(a) a liquid or liquefiable fuel selected from the group consisting of aromatic hydrocarbon compounds forming a continuous emulsion phase;

(B) an aqueous solution of one or more inorganic oxidizer salts forming a discontinuous phase; and (C) an effective amount of a PIBSA-based emulsifying agent.

As used hereinafter, the emulsifying compound used and described in (C) above will be referred to as a "PIBSA-based emulsifier", and is the reaction product of (i) a polyalky(en)yl succinic anhydride which is the addition product of a polymer of a mono-olefin containing 2 to 6 carbon atoms, and having a terminal unsaturated grouping with maleic anhydride, the polymer chain containing from 30 to 500 carbon atoms; and (ii) a polyol, a polyamine, a hydroxyamine, phosphoric acid, sulphuric acid, or monochloroacetic acid.

For improved stability, it is desirable to also include a second emulsifier to create a emulsifier mixture of said PIBSA-based emulsifying agent and a mono-, di- or tri-ester of 1–4 sorbitan and oleic acid, or mixtures thereof.

The sorbitan oleate described hereinabove may be in the form of the mono-, di- or tri-esters or may be in the form of sorbitan sesquioleate which comprises a mixture of the mono-, di- or tri-esters and will be referred to as a "sorbitan sesquioleate".

It has been surprisingly discovered that the use of the above-described emulsifier or emulsifier mixture when employed in the production of a water-in-fuel emulsion explosive, wherein the fuel comprises aromatic hydrocarbon compounds, such as TNT, toluene and nitro benzene, results in an explosive composition which exhibits high strength, substantially improved stability and retained sensitivity particularly when exposed to shear and shock, even at low ambient temperatures. It is postulated that when used in an effective ratio, the sorbitan sesquioleate component of the emulsifier mixture principally acts to emulsify the aqueous and fuel phases and, thereafter, the PIBSA-based component of the emulsifier mixture penetrates the micellar structure and functions to anchor or stabilize the formed emulsion. The requirement of long term stability is desirable in the production of a practical explosive product since, if the emulsion destabilizes or breaks down, useful explosive properties are lost as the compositions often become non-detonatable.

The amount of emulsifier or emulsifier mixture used in the emulsion explosive of the invention will range from 0.5% to 20% by weight of the total composition, preferably, from 0.5% to 10% by weight of the total composition. The ratio of the sorbitan ester emulsifier to the PIBSA-based emulsifier in the mixture may range from 1:1 to :20 and is, preferably, in the range of from 1:1 to 1:5.

The novel water-in-fuel emulsion explosive of the present invention utilizing aromatic hydrocarbon compounds as the fuel phase demonstrates a number of advantages over conventional emulsion explosives employing aliphatic hydrocarbon oils or waxes as the fuel phase. The emulsion explosive of the present invention exhibits great explosive strength or energy, has stability over long periods of storage even at low temperatures and demonstrates resistance to shock and shear. Very fine droplet size is achieved and, hence, close contact of the sale and fuel phases at a sub-micron level is provided for. Balance for oxygen demand is easily accomplished and, hence, total consumption of the ingredients occurs during detonation with little noxious fume production. The composition has the ability to be tailored in consistency from a soft to hard composition depending on packaging requirements and/or end use.

DESCRIPTION OF PREFERRED EMBODIMENTS

The invention is illustrated by the following Examples.

Example I

An experimental emulsion explosive was prepared comprising a mixture of oxidizer salts in the aqueous phase and molten 2,4,6-trinitrotoluene (TNT) as the principal component of the fuel phase. The emulsifier employed was a mixture of sorbitan mono-oleate and lecithin. Glass microballoons were incorporated as an added sensitizer. The resulting explosive was packaged in 25 mm diameter plastic film cartridges and tested for physical and explosive properties. The results are shown in Table I below.

TABLE I

| Ingredients | Mix 1 | Mix 2 | Mix 3 |
|---|---|---|---|
| Sorbitan mono-oleate | 2.0% | 2.0% | 2.0% |
| Lecithin | 2.0 | 2.0 | 2.0 |
| Slackwax | — | 6.0 | 6.0 |
| TNT | 10.0 | 10.0 | 20.0 |
| Oxidizing salts* | 83.5 | 77.5 | 67.5 |
| Microballoons-glass | 2.5 | 2.5 | 2.5 |
| Density, g/cc | Emulsion | 1.17 | 1.23 |
| Minimum primer | did not | R15[1] | R13[2] |
| VOD m/sec | form | 4536 | 4205 |

*Oxidizing salts: AN 66%, SN 16%, CN 5%, Fudge Point 67° C., Water 13%
[1]Contains 0.1 grams lead azide and 0.7 grams PETN base charge.
[2]Contains 0.1 grams lead azide and 0.5 grams PETN base charge.

An examination of Table I shows that an emulsion was formed only when a conventional hydrocarbon fuel (slackwax) was incorporated in the mixture. A microscopic examination of the emulsions of Mix 2 and Mix 3 showed these compositions to resemble conventional water-in-fuel emulsions having fine crystals of TNT dispersed throughout the mixture. The detonation properties of these two mixes were generally poorer than would be expected for a conventional oil-in-water explosive emulsion of the same fuel content.

Example II

A further series of three emulsion explosive mixes were prepared as in Example I except that the emulsifier employed comprised a combination of a PIBSA-based emulsifier (the reaction product of polyisobutyl succinic anhydride and diethanolamine used throughout Examples II to XI) and sorbitan sesquioleate. In the preparation process, the nitroaromatic fuel (TNT) and the emulsifier mixture are melted in a heated mixing bowl and the heated aqueous solution of oxidizer salt was slowly added to the bowl with slow stirring. A clear, transparent emulsion was instantly formed and the mixture was stirred at higher speed for a further five minutes. Thereafter, microballoons and fuel aluminum (powder) were added. The explosive was packaged in 25 mm diameter plastic film cartridges and tested for physical and explosive properties. The results are shown in Table II below:

TABLE II

| Ingredients | Mix 4 | Mix 5 | Mix 6 |
|---|---|---|---|
| PIBSA-based emulsifier | 2.0% | 2.0% | 2.0% |
| Sorbitan sesquioleate | 0.5 | 0.5 | 0.5 |
| TNT | 12.0 | 7.0 | 3.0 |
| Oxidizing salts[1] | 81.5 | 81.5 | 80.5 |
| Microballoons-glass | 4.0 | 4.0 | 4.0 |
| Aluminum | — | 5.0 | 10.0 |
| Oxygen balance | 0.0 | −0.7 | −2.4 |
| Emulsion property[2] | Excellent | Excellent | Excellent |
| Density, g/cc | 1.19 | 1.20 | 1.21 |
| Droplet size μ | | | |
| Average $\bar{X}$ | 0.788 | 0.797 | 0.720 |
| % below 1 | 80.7 | 81.2 | 87.5 |
| Minimum primer | R5[4] | R5 | R5 |
| VOD m/sec | 4601 | 4504 | 4097 |
| Shock crystallized[3] | EB(4401) | EB(4349) | EB Detn. |

[1]Oxidizing salts: AN 77%, SN 11%, water 12%, Fudge Point 75° C.
[2]Visual observation: A clear, transparent, viscous body indicates a fine, stable emulsion (excellent)
[3]Shock crystallized: Samples cooled to −30° C. and repeatedly struck on a hard surface to induce crystallization before testing with an electric blasting cap (EB).
[4]Contains 0.1 grams lead azide and 0.1 grams PETN base charge.

The mixes in Table II were found to be clay-like in nature, non-sticky to the touch and readily moldable. Their sensitivity to breakdown under shear was low, they showed very fine droplet size (0.7–0.8μ average), they demonstrated good detonation properties with minimum priming and a high velocity of detonation (VOD). They remained stable in storage for six months at temperatures ranging from −35° C. to +40° C., were oxygen balanced even when containing 10% aluminum fuel and retained sensitivity to electric blasting cap initiation even when crystallized by shock at low temperature.

Example III

A further series of three emulsion explosives mixes were prepared as described in Example II. Again, the explosives were packaged in 25 mm diameter plastic film cartridges and tested for physical and explosive properties. The results are shown in Table III below.

TABLE III

| Ingredients | Mix 7 | Mix 8 | Mix 9 | Mix 10 |
|---|---|---|---|---|
| PIBSA-based emulsifier | 2.0% | 2.0% | 2.0% | 2.0% |
| Sorbitan sesquioleate | — | 0.5 | 0.5 | 0.5 |
| TNT | 12.0 | — | — | 15.0 |
| Toluene | — | 3.0 | — | — |
| Nitrobenzene | — | — | 3.0 | — |
| Oxidizing salts[1] | 82.0 | 90.5 | 90.5 | 78.5 |
| Microballoons-glass | 4.0 | 4.0 | 4.0 | 4.0 |
| Density, g/cc | 1.19 | 1.17 | 1.17 | 1.20 |
| Hardness[2] | 47 | 200 | | |
| Rise in shear temperature[3] | 9° C. | 22° C. | | |
| Droplet size μ | | | | |
| Average $\bar{X}$ | 0.738 | 1.02 | 0.971 | 0.996 |
| % Below 1 | 89.1 | 53.0 | 61.7 | 56.4 |
| Minimum primer | R6[4] | R6 | R6 | R5 |
| VOD m/sec | 3735 | 3896 | 4123 | 4610 |
| Shock crystallized | EB(3325) | EB(3528) | EB(3414) | |

[1]Oxidizing salts: AN 77%, SN 11%, water 12%
[2]Measured by the penetrating cone test
[3]Measured by the "Rolling Pin Test" which consists of a roller which passes on a fixed track, a platform of variable height on which is placed a cartridge of the explosive to be tested and a thermocouple temperature probe and readout. The passage of the roller imparts shear by flattening the cartridge to the specified clearance and the temperature rise is then recorded. This test was performed with the cap-sensitive packaged formulation at temperatures ranging from ambient to −35° C. The "rise in shear temperature", as determined on the temperature rise versus test temperature curve, was the test temperature at which the temperature rise was 16° C.
[4]Contains 0.1 grams lead azide and 0.15 grams PETN base charge.

With reference to Table III, it can be seen that Mix 7, devoid of the sorbitan sesquioleate component, formed an emulsion which was much more sensitive to shear ($T_{16}$—9° C.) than those shown in Table II above. In Mix 8, toluene was employed as the aromatic fuel phase and in Mix 9, nitrobenzene fuel was used. In Mix 10, a relatively high volume of TNT was utilized.

Example IV

A further series of four emulsion explosives mixes were prepared as described in Example III employing sorbitan mono-oleate as the major emulsifying component. The explosives were packaged in 25 mm diameter plastic film cartridges and were tested for physical and explosive properties. The results are shown in Table IV below.

TABLE IV

| Ingredients | Mix 11 | Mix 12 | Mix 13 | Mix 14 |
|---|---|---|---|---|
| PIBSA-based emulsifier | 2.0% | 2.0% | 2.0% | — |

TABLE IV-continued

| Ingredients | Mix 11 | Mix 12 | Mix 13 | Mix 14 |
|---|---|---|---|---|
| Sorbitan mono-oleate | 0.5 | 1.0 | 2.0 | 1.8 |
| TNT | 12.0 | 12.0 | 12.0 | 13.4 |
| Oxidizer salts[1] | 81.5 | 81.0 | 80.0 | 79.8 |
| Microballoons-glass | 4.0 | 4.0 | 4.0 | 5.0 |
| Density, g/cc | 1.17 | 1.17 | 1.17 | Formed but not stable |
| Hardness[2] | 150 | 157 | 183 | |
| Rise in shear temperature | −21° C. | −23° C. | −23° C. | |
| Droplet size μ | | | | |
| Average $\bar{X}$ | 0.81 | 0.64 | 0.72 | |
| % Below 1 | 78.5 | 95.0 | 92.5 | |
| Minimum primer | R5 | R6 | R5 | Failed EB |
| VOD km/sec | 4.2 | 4.8 | 4.9 | |

[1]AN/SN Liquor: 77% AN, 11% SN, 12% Water
[2]Measured by penetrating cone test.

With reference to Table IV, it is seen that Mix 14, devoid of any PIBSA-based emulsifier, formed an emulsion which was unstable. Mix 11, employing 0.5% of sorbitan mono-oleate, formed a stable emulsion which, when examined under the microscope, showed emulsion droplets intermixed with TNT crystals. Mixes 12 and 13 showed no evidence of TNT crystals under microscopic examination.

Example V

In order to determine the useful ranges of PIBSA-based emulsifier and sorbitan sesquioleate emulsifier which could be employed with the explosive compositions of the invention, a series of ten mixes were prepared in the manner described in Example II, wherein the amount of both emulsifiers was varied independently. The resulting emulsions were examined for physical and explosive properties which are recorded in Table V-A and Table V-B, below:

TABLE V-A

| | Useful Range of PIBSA-based Emulsifier | | | | |
|---|---|---|---|---|---|
| Ingredients | Mix 15 | Mix 16 | Mix 17 | Mix 18 | Mix 19 |
| PIBSA-based emulsifier | 0.5% | 1.0% | 2.0% | 4.0% | 8.0% |
| Sorbitan sesquioleate | 0.5 | 0.5 | 0.5 | 0.5 | 0.5 |
| TNT | 12.0 | 12.0 | 12.0 | 12.0 | 12.0 |
| AN/SN liquor | 83.0 | 82.5 | 81.5 | 79.5 | 75.5 |
| Microballoons-glass | 4.0 | 4.0 | 4.0 | 4.0 | 4.0 |
| Density, g/cc | 1.19 | 1.19 | 1.19 | 1.19 | 1.19 |
| Hardness[1] | 25 | 65 | 145 | +200 | +200 |
| Rise in shear temperature[2] | 0° C. | −15.5° C. | −23° C. | −28° C. | −35° C. |
| MP (VOD) km/sec | Failed | R9(4.1) | R5(4.6) | R5(5.1) | R7(4.7) |
| Droplet size μ | | | | | |
| Average $\bar{X}$ | 0.65 | 0.80 | 0.79 | 0.62 | 0.83 |
| % below 1 | 97.6 | 79.7 | 80.7 | 95.9 | 72.4 |

[1]Hardness is a measure of the physical hardness of the product measured by penetating cone test. Larger numbers = softer product.
[2]The rise in shear temperature is a measure of shear sensitivity. The lower the temperature, the better.

As can be seen from the results recorded in Table V-A, the amount of PIBSA-based emulsifier required to form a stable emulsion must be greater than 0.5% of the total composition and may be as great as 8.0% of more. As the amount of PIBSA-based emulsifier in the mixture is increased, the compositions becomes softer and less sensitive to shear. In all cases, the droplet size is below 1μ. The preferred amount of PIBSA-based emulsifier is from 0.5% to 10.0% by weight of the total composition.

TABLE V-B

| | Useful Range of Sorbitan Sesquioleate Emulsifier | | | | |
|---|---|---|---|---|---|
| Ingredients | Mix 20 | Mix 21 | Mix 22 | Mix 23 | Mix 24 |
| PIBSA-based emulsifier | 2.0% | 2.0% | 2.0% | 2.0% | 2.0% |
| Sorbitan sesquioleate | — | 0.5 | 1.0 | 2.0 | 4.0 |
| TNT | 12.0 | 12.0 | 12.0 | 12.0 | 12.0 |
| AN/SN liquor | 82.0 | 81.5 | 81.0 | 80.0 | 78.0 |
| Microballoons-glass | 4.0 | 4.0 | 4.0 | 4.0 | 4.0 |
| Density, g/cc | 1.19 | 1.19 | 1.19 | 1.19 | 1.19 |
| Hardness | 47 | 145 | 152 | 175 | +200 |
| Rise in shear temperature | −9° C. | −23° C. | −25 ° C. | −27.5° C. | −21° C. |
| MP (VOD) km/sec | R6(3.7) | R5(4.6) | R6(4.8) | R6(4.6) | R6(4.8) |
| Droplet size μ | | | | | |
| Average $\bar{X}$ | 0.74 | 0.79 | 0.65 | 0.88 | 0.61 |
| % below 1 | 89.1 | 80.7 | 97.1 | 69.5 | 100 |

From the results recorded in Table V-B, it can be seen that in the absence of sorbitan sesquioleate (Mix 20), the composition is highly sensitive to shear. As the quantity of the emulsifier is increased, the composition becomes stable and less prone to shear and shock crystallization. The preferred amount of sorbitan sesquioleate emulsifier is from 0.5% to 10.0% by weight of the total composition.

Example VI

To determine the effectiveness of sorbitan trioleate as the minor emulsifier in the explosive composition of the invention, a series of mixes were prepared in the manner described in Example II. When the composition was devoid of any PIBSA-based emulsifier but contained 3% by weight of sorbitan trioleate as the sole emulsifier, no emulsion was formed. Employing a combination of 2% PIBSA-based emulsifier and 0.5% of sorbitan trioleate, a partially crystallized emulsion was formed. A combination of 2% PIBSA-based emulsifier and 2% sorbitan trioleate produced an excellent, stable emulsion. Results are shown in Table VI, below.

TABLE VI

| Effectiveness of Sorbitan Trioleate Emulsifier | | | | |
|---|---|---|---|---|
| Ingredients | Mix A | Mix B | Mix C | Mix D |
| PIBSA-based emulsifier | — | 2.0% | 2.0% | 2.00% |
| Sorbitan Trioleate | 3.0 | 0.5 | 1.0 | 2.0 |
| TNT | 12.0 | 12.0 | 12.0 | 12.0 |
| AN/SN liquor | 81.0 | 81.5 | 81.0 | 80.0 |
| Microballoons-glass | 4.0 | 4.0 | 4.0 | 5.0 |
| Emulsion property | Emulsion did not form | Partially crystal-lized | Partially crystal-lized | Excellent |
| MP VOD km/sec | | R6(4.5) | R6(4.6) | R6(4.8) |
| Droplet size μ | | | | |
| Average $\overline{X}$ | | 0.95 | 0.77 | 0.91 |
| % Below 1 | | 71.1 | 88.7 | 66.4 |

Example VII

To determine the maximum amount of aromatic fuel component which can be tolerated in the explosive composition of the invention, a series of mixes were prepared as described in Example II wherein the amount of the aromatic fuel was varied from 12% to 25% by weight of the total composition. The results are shown by Table VII, below:

TABLE VII

| Effect of TNT Content on Emulsion | | | | |
|---|---|---|---|---|
| Ingredients | Mix 25 | Mix 26 | Mix 27 | Mix 28 |
| PIBSA-based emulsifier | 2.0% | 2.0% | 2.0% | 2.0% |
| Sorbitan sesquioleate | 0.5 | 0.5 | 0.5 | 0.5 |
| TNT | 12.0 | 15.0 | 20.0 | 25.0 |
| AN/SN liquor | 81.5 | 78.5 | 73.5 | 68.5 |
| Microballoons-glass | 4.0 | 4.0 | 4.0 | 4.0 |
| Density, g/cc | 1.19 | 1.20 | 1.20 | Not stable sweating |
| Hardness | 145 | 125 | 147 | |
| Rise in shear temperature | −23° C. | −23.5° C. | −21° C. | |
| MP (VOD) km/sec | R6(4.6) | R6(4.7) | R6(4.7) | |
| Droplet size μ | | | | |
| Average $\overline{X}$ | 0.79 | 0.67 | 0.73 | |
| % below 1 | 80.7 | 91.6 | 88.4 | |

From the results recorded in Table VII, it can be seen that an amount of aromatic fuel above about 25% by weight of the total composition leads to an unstable emulsion.

Example VIII

A series of explosive emulsion mixes were prepared by the method described in Example II using a variety of aromatic hydrocarbons as the fuel phase. The explosives, cartridged in 25 mm diamter plastic film packages, were examined for physical and explosive properties which are tabulated in Table VIII below.

TABLE VIII

| Emulsions with Variety of Fuels | | | | | | |
|---|---|---|---|---|---|---|
| Ingredients | Mix 29 | Mix 30 | Mix 31 | Mix 32 | Mix 33 | Mix 34 |
| PIBSA-based emulsifier | 2.0% | 2.0% | 2.0% | 2.0% | 2.0% | 2.0% |
| Sorbitan sesquioleate | 0.5 | 0.5 | 0.5 | 0.5 | 0.5 | 0.5 |
| Nitrobenzene | 3.0 | | | | | |
| Chlorobenzene | | 3.0 | | | | |
| Cyclohexane | | | 3.0 | | | |
| Toluene | | | | 3.0 | | |
| Xylene | | | | | 3.0 | |
| Anthracen | | | | | | 3.0 |
| AN/SN liquor | 90.5 | 90.5 | 90.5 | 90.5 | 90.5 | 90.5 |
| Microballoons-glass | 4.0 | 4.0 | 4.0 | 4.0 | 4.0 | 4.0 |
| Density, g/cc | 1.17 | 1.17 | 1.17 | 1.17 | 1.17 | 1.17 |
| Hardness | | 192 | 175 | 200 | 168 | 165 |
| Rise in shear temperature | | −27° C. | −22.5° C. | −22° C. | −24° C. | −22.5° C. |
| MP (VOD) km/sec | R6(4.1) | R6(4.2) | R6(4.3) | R6(4.1) | R6(4.3) | R6(4.1) |
| Droplet size μ | | | | | | |
| Average $\overline{X}$ | 0.97 | 0.90 | 0.72 | 1.02 | 0.72 | 0.72 |
| % below 1 | 61.7 | 72.1 | 91.7 | 53.0 | 89.1 | 89.3 |

The emulsions recorded in Table VIII were generally soft in consistency, were very stable to shock and shear, had good sensitivity to primer initiation and had submicron droplet size.

Example IX

A series of four explosive emulsion mixes were prepared by the method described in Example II using conventional paraffinic hydrocarbon fuels in combination with aromatic hydrocarbon fuels. The explosives were cartridged in 25 mm diameter plastic film packages and were examined for physical and explosives properties. The results are shown in Table IX, below.

TABLE IX

| Ingredients | Mix 35 | Mix 36 | Mix 37 | Mix 38 |
|---|---|---|---|---|
| PIBSA-based emulsifier | 2.0% | 2.0% | 2.0% | 2.0% |
| Sorbitan sesquioleate | 0.5 | 0.5 | 0.5 | 0.5 |
| TNT | 12.0 | 12.0 | 12.0 | 12.0 |
| HT-22 oil | — | 2.0 | — | — |
| Slackwax | — | — | 2.0 | — |
| Paraffin wax | — | — | — | 0.3 |
| Synthetic wax | — | — | — | 0.9 |
| AN/SN liquor | 81.5 | 79.5 | 79.5 | 80.6 |
| Microballoons-glass | 4.0 | 4.0 | 4.0 | 4.0 |
| Density, g/cc | 1.19 | 1.19 | 1.19 | 1.19 |
| Hardness | 145 | 220 | 146 | 93 |
| Rise in shear temperature | −23° C. | −34° C. | −18° C. | −17° C. |
| MP (VOD) km/sec | R6(4.6) | R5(4.9) | R6(4.8) | R5(5.1) |
| Droplet size μ | | | | |
| Average $\bar{X}$ | 0.79 | 1.63 | 1.44 | 1.11 |
| % below 1 | 80.7 | 15.4 | 22.1 | 45.9 |

All the emulsion explosives recorded in Table IX exhibited good sensitivity and a high level of shock/shear stability. They ranged in consistency from soft ($P_{22}$—200) to hard ($P_{22}$—93). Droplet size ranged from 0.79μ to 1.63μ. The results indicate that satifactory emulsion explosives can be produced wherein the fuel phase comprises a mixture of aromatic and aliphatic hydrocarbons.

Example X

A basic explosive emulsion was made, as described in Example II, with 2.0% PIBSA-based emulsifier, 0.5% sorbitan sesquioleate, 12% TNT and 85.5% oxidizing salts liquor (AN/SN/water 77%/11%/12%, Fudge Point 75° C. The emulsion density was adjusted by different levels of B-23 glass microballoons (from 4 to 1.5%), cartridged in different sizes (from 50 mm to 18 mm diameter), and tested for VOD. The results are tabulated in Table X, below.

TABLE X

| Detonation Velocity of Emulsified TNT Explosive (VOD m/sec) | | | | | |
|---|---|---|---|---|---|
| Diameter | Density, g/cc | | | | |
| (mm) | 1.19 | 1.23 | 1.30 | 1.32 | 1.34 |
| 50 | 5040 | 5248 | 4922 | 5000 | 3360 |
| 40 | 4739 | 4847 | 4536 | 4885 | 3414 |
| 25 | 4410 | 4205 | 3567 | 3083 | Failed |
| 18 | 3757 | 3508 | Failed | Failed | Failed |

The data in Table X indicates that the detonation velocity (VOD) of emulsified TNT explosives is generally higher than the VOD found with conventional emulsion explosives using oils/waxes as the fuel phase.

Example XI

Emulsified TNT explosives made with or without added fuel aluminum were tested underwater in comparison to conventional oils/waxes emulsions or TNT doped emulsions. Data in Table XI below were expressed in total shock and bubble energy released.

TABLE XI

| Underwater Test Results | |
|---|---|
| Emulsified TNT Explosive | Total Energy (mJ/kg) |
| 15% TNT | 2.60 |
| 12% TNT | 2.50 |
| 7% TNT and 4.8% Al | 2.67 |
| 3% TNT and 10% Al | 3.35 |

TABLE XI-continued

| Oils/waxes Emulsion | Total Energy (mJ/kg) |
|---|---|
| 10% TNT doped | 2.30 |
| 20% TNT doped | 2.40 |
| 20% AN doped | 2.05 |
| 4.8% Al | 2.40 |
| 10.0% Al | 2.90 |

12% Emulsified TNT explosive, for example, is higher in energy than conventional oils/waxes emulsion containing 4.8% fuel aluminum (2.50 mJ/kg vs. 2.40 mJ/kg), and higher than 10% to 20% TNT doped emulsions (2.50 mJ/kg vs. 2.30 to 2.40 mJ/kg).

With added fuel aluminum, emulsified TNT explosives give 11% to 15% more in energy than the equivalent oils/waxes emulsions (e.g. 3% TNT and 10% aluminum vs. 10% aluminum emulsion).

The preferred inorganic oxygen-supplying salt suitable for use in the discontinuous aqueous phase of the water-in-fuel emulsion composition is ammonium nitrate; however, a portion of the ammonium nitrate may be replaced by other oxygen-supplying salts, such as alkali or alkaline earth metal nitrates, chlorates, perchlorates or mixtures thereof. The quantity of oxygen-supplying salt used in the composition may range from 30% to 90% by weight of the total.

The amount of water employed in the discontinuous aqueous phase will generally range from 5% to 25% by weight of the total composition.

Suitable aromatic hydrocarbon fuels which may be employed in the emulsion explosives include, for example, benzene, toluene, xylene, anthracene, nitrobenzene, chlorobenzene, trinitrotoluene and the like. The quantity of aromatic hydrocarbon fuel used may comprise from 1% to 30% and, preferably, 3% to 25% by weight of the total composition.

Suitable water-immiscible fuels which may be used in combination with the aromatic hydrocarbon fuels include most hydrocarbons, for example, paraffinic, olefinic, naphthenic, elastomeric, saturated or unsaturated hydrocarbons. Generally, these may comprise up to 50% of the total fuel content without deleterious affect.

Occluded gas bubbles may be introduced in the form of glass or resin microspheres or other gas-containing particulate materials. Alternatively, gas bubbles may be generated in-situ by adding to the composition and distributing therein a gas-generating material such as, for example, an aqueous solution of sodium nitrite.

Optional additional materials may be incorporated in the composition of the invention in order to further improve sensitivity, density, strength, rheology and cost of the final explosive. Typical of materials found useful as optional additives include, for example, emulsion promotion agents such as highly chlorinated paraffinic hydrocarbons, particulate oxygen-supplying salts such as prilled ammonium nitrate, calcium nitrate, perchlorates, and the like, ammonium nitrate/fuel oil mixtures (ANFO), particulate metal fuels such as aluminum, silicon and the like, particulate non-metal fuels such as sulphur, gilsonite and the like, particulate inert materials such as sodium chloride, barium sulphate and the like, water phase or hydrocarbon phase thickeners such as guar gum, polyacrylamide, carboxymethyl or ethyl cellulose, biopolymers, starches, elastomeric materials, and the like, crosslinkers for the thickeners such as potassium pyroantimonate and the like, buffers or pH controllers such as sodium borate, zinc nitrate and the like, crystals habit modifiers such as alkyl naphthalene sodium sulphonate and the like, liquid phase extenders such as formamide, ethylene glycol and the like and bulking agents and additives of common use in the explosives art.

The PIBSA-based emulsifier component of the essential emulsifier mixture may be produced by the method disclosed by A. S. Baker in Canadian Patent No. 1,244,463 dated Nov. 8, 1988. The sorbitan mono-, di- and tri-sesquioleate and components of the essential emulsifier mixture may be purchased from commerial sources.

The preferred methods for making the water-in-fuel emulsion explosive compositions of the invention comprise the steps of:

(a) mixing the water, inorganic oxidizer salts and, in certain, cases, some of the optional water-soluble compounds, in a first premix;

(b) mixing the aromatic hydrocarbon fuel, emulsifying agent and any other optional oil soluble compounds, in a second premix; and (c) adding the first premix to the second premix in a suitable mixing apparatus, to form a water-in-fuel emulsion.

The first premix is heated until all the salts are completely dissolved and the solution may be filtered if needed in order to remove any insoluble residue. The second premix is also heated to liquefy the ingredients. Any type of apparatus capable of either low or high shear mixing can be used to prepare the emulsion explosives of the invention. Glass microspheres, solid fuels such as aluminum or sulphur, inert materials such as barytes or sodium chloride, undissolved solid oxidizer salts and other optional materials, if employed, are added to the microemulsion and simply blended until homogeneously dispersed throughout the composition.

The water-in-fuel emulsion of the invention can also be prepared by adding the second premix liquefied fuel solution phase to the first premix hot aqueous solution phase with sufficient stirring to invert the phases. However, this method usually requires substantially more energy to obtain the desired dispersion than does the preferred reverse procedure. Alternatively, the emulsion is adaptable to preparation by a continuous mixing process where the two separately prepared liquid phases are pumped through a mixing device wherein they are combined and emulsified.

The emulsion explosives herein disclosed and claimed represent an improvement over more conventional oil/waxes fueled emulsions in many respects. In addition to providing the first practical means whereby high energy aromatic hydrocarbon fuels may be emulsified with saturated aqueous salt solutions, the invention provides an explosive of superior properties. These include high strength, enhanced sensitivity, especially at low temperatures, variable hardness, resistance to desensitization caused by exposure to shock or shear, intimate contact of the phases due to small droplet size and ease of oxygen balance.

The examples herein provided are not to be construed as limiting the scope of the invention but are intended only as illustrations. Variations and modifications will be evident to those skilled in the art.

I claim:

1. A water-in-fuel emulsion explosive composition comprising:

(A) a liquid or liquefiable fuel consisting of an aromatic hydrocarbon compound forming a continuous emulsion phase;

(B) an aqueous solution of one or more inorganic oxidizer salts forming a discontinuous phase; and (C) an effective amount of a polyisobutyl succinic anhydride-based emulsifying agent.

2. An explosive composition as claimed in claim 1 wherein said aromatic hydrocarbon compound is selected from the group consisting of nitromethane, nitrobenzene, chlorobenzene, benzene, toluene, xylene, trinitroluene and mixtures thereof.

3. An explosive composition as claimed in claim 2 wherein up to 50% by weight of the said aromatic hydrocarbon compound is replaced by a water-immiscible hydrocarbon.

4. An explosive composition as claimed in claim 1 wherein the oxidizer salt is ammonium nitrate.

5. An explosive composition as claimed in claim 4 wherein up to 50% by weight of the ammonium nitrate is replaced by one or more inorganic salts selected from the group of alkali and alkaline earth metal nitrates and perchlorates.

6. An explosive composition as claimed in claim 1 wherein said polyisobutyl succinic anhydride-based emulsifying agent is the reaction product of:

(i) a polyalk(en)yl succinic anhydride which is the addition product of a polymer of a mono-olefin containing 2 to 6 carbon atoms, and having a terminal unsaturated grouping with maleic anhydride, the polymer chain containing from 30 to 500 carbon atoms; and (ii) a polyol, a polyamine, a hydroxyamine, phosphoric acid, sulphuric acid or monochloroacetic acid.

7. An explosive composition as claimed in claim 6 wherein said composition comprises an emulsifier mixture of said polyisobutyl succinic anhydride-based emulsifying agent and a mono-, di-, or tri-ester of 1–4 sorbitan and oleic acid, or mixtures thereof.

8. An explosive composition as claimed in claim 7 wherein the said emulsifying mixture comprises up to 20% by weight of the total composition.

9. An explosive composition as claimed in claim 7 wherein the said emulsifying mixture comprises up to 10% by weight of the total composition.

10. An explosive composition as claimed in claim 7 wherein the ratio of sorbitan ester emulsifier to polyisobutyl succinic anhydride-based emulsifier is from 1:1 to 1:5.

11. An explosive composition as claimed in claim 7 wherein the ratio of sorbitan ester emulsifier to polyisobutyl succinic anhydride-based emulsifier is from 1:2 to 1:20.

12. An emulsion explosive of the water-in-fuel type consisting essentially of:

(A) a discontinuous phase comprising 5–25% by weight of water and from 30–95% by weight of one or more soluble inorganic oxidizer salts;

(B) a continuous phase comprising from 3–25% by weight of an aromatic compound; and (C) an effective amount of an emulsifying agent comprising up to 20% by weight of the total composition, the said emulsifying agent comprising a mixture of:

(a) an amount of a polyisobutyl succinic anhydride-based compound which is the reaction product of:

(i) a polyalk(en)yl succinic anhydride which is the addition product of a polymer of a mono-olefin containing 2 to 6 carbon atoms, and having a terminal unsaturated grouping with maleic anhydride, the polymer chain containing from 30 to 500 carbon atoms; and (ii) a polyol, polyamine, a hydroxyamine, phosphoric acid, sulphuric acid or monochloroacetic acid; and (b) an amount of mono-, di- or tri-ester of 1–4 sorbitan and oleic acid.

13. An explosive composition as claimed in claim 12 wherein the ratio of sorbitan ester emulsifier to polyisobutyl succinic anhydride-based emulsifier is from 1:1 to 1:20.

* * * * *